US006895204B2

(12) United States Patent
Shin

(10) Patent No.: US 6,895,204 B2
(45) Date of Patent: May 17, 2005

(54) ELECTROPHOTOGRAPHIC PRINTER HAVING IMAGE CHARGING UNIT TO REDUCE ADHESIVE FORCE OF TRANSFERRED IMAGE AND METHOD THEREOF

(75) Inventor: Kyu-cheol Shin, Gwacheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/315,057

(22) Filed: Dec. 10, 2002

(65) Prior Publication Data

US 2004/0001730 A1 Jan. 1, 2004

(30) Foreign Application Priority Data

Jun. 29, 2002 (KR) ..... 2002-37520

(51) Int. Cl.[7] ..... G03G 15/16
(52) U.S. Cl. ..... 399/296; 399/299
(58) Field of Search ..... 399/296, 297, 399/298, 299, 302, 308, 128, 179; 430/47, 126; 361/229; 347/118

(56) References Cited

U.S. PATENT DOCUMENTS 4,550,253 A * 10/1985 Hashimoto ..... 361/229
5,189,478 A * 2/1993 Hara et al. ..... 399/66
5,771,432 A * 6/1998 Nakayama ..... 399/302
6,430,379 B1 * 8/2002 Takahashi et al. ..... 399/302
6,667,752 B2 * 12/2003 Wagner et al. ..... 347/130

FOREIGN PATENT DOCUMENTS

JP 2000094734 A * 4/2000 ..... B41J/2/385

* cited by examiner

*Primary Examiner*—Robert Beatty
(74) *Attorney, Agent, or Firm*—Staas & Halsey LLP

(57) ABSTRACT

An image forming system of an electrophotographic printer. The system includes a photosensitive body on which an electrostatic latent image is formed, a developing unit which develops the electrostatic latent image with a developer, a transfer body onto which the developed image is transferred, a first image charging unit which charges the image so as to increase an electric adhesive force of the image transferred onto the transfer body, a second image charging unit which charges the image so as to reduce the electric adhesive force of the image transferred onto the transfer body in the rear of the first image charging unit, and a transfer unit which transfers the image passing through the first and second image charging units onto paper. When the image is transferred onto the transfer body, the first image charging unit increases the electric adhesive force of the image and prevents the image from dispersing, and the second image charging unit reduces the adhesive force suitable for transfer just before the image is transferred onto the paper, and thus the clear image can be maintained, and a transfer efficiency can be improved.

14 Claims, 2 Drawing Sheets

ELECTROPHOTOGRAPHIC PRINTER HAVING IMAGE CHARGING UNIT TO REDUCE ADHESIVE FORCE OF TRANSFERRED IMAGE AND METHOD THEREOF

CROSS-REFERENCE TO RELATED APPLICATIONS

This application claims the benefit of Korean Application No. 2002-37520, filed Jun. 29, 2002, in the Korean Intellectual Property Office, the disclosure of which is incorporated herein by reference.

BACKGROUND OF THE INVENTION

1. Field of the Invention

The present invention relates to an image forming system of an electrophotographic printer and a method of forming an image using the same.

2. Description of the Related Art

As shown in FIG. 1, a conventional image forming system of an electrophotographic printer (such as a color laser printer or the like) includes four photosensitive drums Dy, Dm, Dc, and Dk, which correspond to four colors such as yellow, magenta, cyan, and black, a charger 11 to charge the photosensitive drums Dy, Dm, Dc, and Dk, and an exposing unit 12 to radiate light onto each of the charged photosensitive drums Dy, Dm, Dc, and Dk and to form a desired electrostatic latent image thereon. The conventional apparatus further includes a developing unit 13 to develop the electrostatic latent image with a developer for each of the four colors, a transfer belt 14 on which the images having the four colors developed on the photosensitive drums Dy, Dm, Dc, and Dk are sequentially overlapped and a complete color image is formed, and a transfer unit 16 to transfer the image having the four overlapped colors on the transfer belt 14 onto a paper P. Thus, in order to print the desired color image, an image for each of the four colors is developed on the four photosensitive drums Dy, Dm, Dc, and Dk, and each image is sequentially overlapped on the transfer belt 14, thereby forming a final color image, which then is printed onto the paper P by the transfer unit 16.

The transfer unit 16 includes a paper transfer roller 16*a* and a paper transfer backup roller 16*b* to closely press the paper P against the transfer belt 14, and a potential applying unit 16*c* to apply a voltage to the paper transfer backup roller 16*b* and to apply an electric force so that the image formed on the transfer belt 14 is transferred onto the paper P. In FIG. 1, the developer used to form an image is positively charged. The potential applying unit 16*c* applies a positive voltage to the paper transfer backup roller 16*b* so that the image is transferred onto the paper P by an electric repulsive force. That is, when the image developed on the photosensitive drums Dy, Dm, Dc, and Dk are transferred onto the transfer belt 14, a negative voltage is applied to a corresponding backup roller 15 of each of the photosensitive drums Dy, Dm, Dc, and Dk so that a toner image charged positively by an electric repulsive force is transferred onto the transfer belt 14. When the image is transferred onto the paper P, a positive voltage is applied to the paper transfer backup roller 16*b* so that the toner image is transferred onto the paper P from the transfer belt 14 by a repulsive force.

The entire image formed on the transfer belt 14 is transferred onto the paper P. However, in the above structure, the image formed on the transfer belt 14 is transferred onto the paper P by an electric force caused by a voltage applied to the paper transfer backup roller 16*b*, and thus the developer that is not transferred onto the transfer belt 14 remains after this transfer operation. Of course, pressure which acts to closely press the paper P to the transfer belt 14 is generated by the paper transfer roller 16*a* and the paper transfer backup roller 16*b*. However, this pressure is less than 3 kgf and only acts to closely attach the paper P to the transfer belt 14.

Meanwhile, a method to increase the attaching pressure has been proposed in order to improve the image transfer efficiency. In this case, even if the transfer efficiency is increased slightly, the toner remaining on the transfer belt 14 is too strongly attached to the transfer belt 14 such that the toner cannot be properly cleaned, and thus the lifespan of the transfer belt 14 is reduced. The concentration of the developer may be reduced to reduce the amount of the toner of the image formed on the transfer belt 14. However, in this case, when the image is compressed between the photosensitive drums Dy, Dm, Dc, and Dk and the backup roller 15, and between the paper transfer roller 16*a* and the paper backup transfer roller 16*b*, a liquid carrier that is contained in the image is squeezed and flows out, and thus the image spreads excessively.

Also, in the case of a color image, the toner having the four colors such as yellow, magenta, cyan, and black, is sequentially overlapped on the transfer belt 14 by an electric force generated in the developing unit 13 for each color, and a color image is formed. Hence, in this procedure, the electric force which acts to attach the toner to the transfer belt 14, is accumulated gradually and increased, and thus the color image may not be properly transferred onto the paper P.

Thus, an image forming system which solves these problems and more stably performs a transfer operation from the photosensitive drums Dy, Dm, Dc, and Dk onto the paper P through the transfer belt 14 is needed.

SUMMARY OF THE INVENTION

Accordingly, it is an object of the present invention to provide an image forming system having an improved structure in which an image developed on a photosensitive medium is stably transferred onto paper through an intermediate transfer body, and a method of forming an image using the same.

Additional objects and advantages of the invention will be set forth in part in the description which follows and, in part, will be obvious from the description, or may be learned by practice of the invention.

The foregoing and/or other objects of the present invention are achieved by providing an image forming system of an electrophotographic printer, the system including a photosensitive body on which an electrostatic latent image is formed; a developing portion which develops the electrostatic latent image with a developer having a color; a transfer body onto which the developed image is transferred; a first image charging unit which charges the transferred image so as to increase an electric adhesive force of the transferred image to the transfer body; a second image charging unit which charges the transferred image so as to reduce the electric adhesive force of the transferred image; and a transfer unit which transfers the image passing through the first and second image charging units onto a paper.

The foregoing and/or other objects of the present invention are achieved by providing a method of forming an image of an electrophotographic printer, the method including developing an electrostatic latent image formed on a photosensitive body by a developer having a color; transferring the developed image onto a transfer body; charging the developed image so that an electric adhesive force to the transfer body is increased; charging the developed image so that the electric adhesive force to the charged transfer body is reduced; and transferring the charged image having the reduced force onto a paper.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
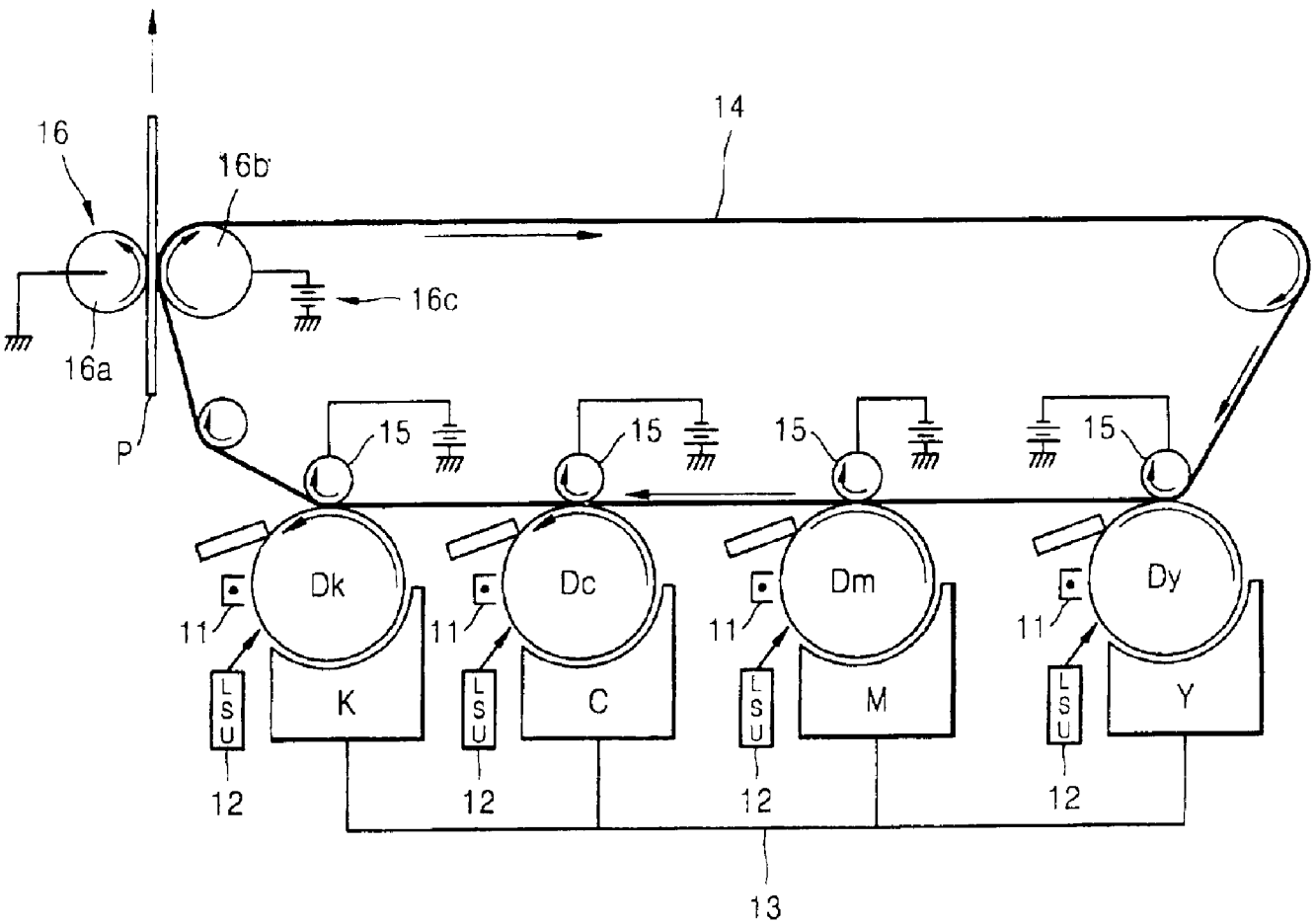
FIG. 1 (PRIOR ART)
FIG. 1 illustrates a conventional image forming system of an electrophotographic printer.

Reference will now be made in detail to the present preferred embodiments of the present invention, examples of which are illustrated in the accompanying drawings, wherein like reference numerals refer to like elements throughout.

Figure 2:
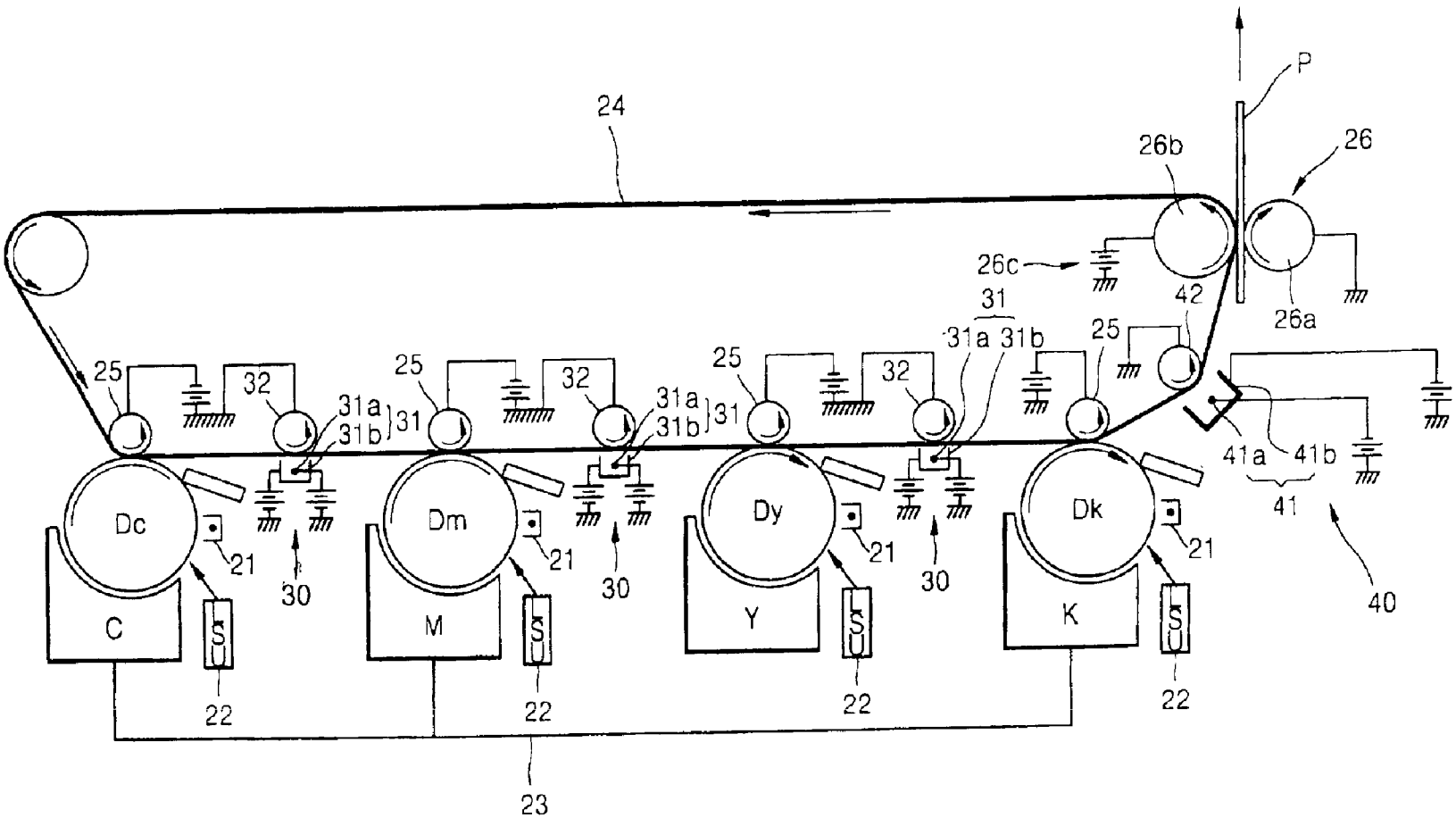
FIG. 2 illustrates an image forming system of an electrophotographic printer according to an embodiment of the present invention.

FIG. 2 illustrates an image forming system of an electrophotographic printer according to an embodiment of the present invention. As shown in FIG. 2, the image forming system of the electrophotographic printer includes four photosensitive drums Dc, Dm, Dy, and Dk as the photosensitive bodies, chargers 21 to charge the photosensitive drums Dc, Dm, Dy, and Dk, laser scanning units (LSU) 22 as exposing units to radiate light onto each of the charged photosensitive drums Dc, Dm, Dy, and Dk and to form a desired electrostatic latent image. The image forming system further includes a developing unit 23 to develop the electrostatic latent image with a developer for each of the four colors, a transfer belt 24 onto which the image having the four colors developed on the photosensitive drums Dc, Dm, Dy, and Dk is first transferred, and a transfer unit 26 to then transfer the image having the four colors transferred from the transfer belt 24 onto the paper P.

The present embodiment exemplifies an image forming system to realize a color image. For this purpose, the developing unit has four colors, for example, cyan (C), magenta (M), yellow (Y), and black (K). Thus, an image which corresponds to each of the four colors is developed on the photosensitive drums Dc, Dm, Dy, and Dk, and is overlapped on the transfer belt 24, and thereby a color image is formed. Reference numeral 25 denotes a backup roller for each developing unit, and a negative (−) voltage is applied to the backup roller 25, as shown in FIG. 2. This is because toner particles, which are the main components of the developer, are positively charged, and an electric bias is applied to the backup rollers 25 so that the toner particles are transferred onto the transfer belt 24. If the toner particles are negatively charged, a positive (+) voltage is applied to the backup rollers 25. A roller with low hardness may be used for the backup roller 25 to minimize pressure when the image is transferred onto the transfer belt 24. If the pressure increases too much, liquid contained in the image may be squeezed and thus flows out.

The transfer unit 26 includes a paper transfer roller 26*a* and a paper transfer backup roller 26*b* which are closely attached to each other and rotate in opposite directions, with the transfer belt 24 installed between the paper transfer roller 26*a* and the paper transfer backup roller 26*b*. The transfer unit 26 further includes a potential applying unit 26*c* to apply a potential to the paper transfer backup roller 26*b*. The potential applying unit 26*c* applies a positive voltage having the same polarity as the polarity of the developer to the paper transfer backup roller 26*b* such that the positively charged image is completely transferred onto the paper P. That is, when the image is first transferred onto the transfer belt 24, the transfer is induced by an attractive force caused by a negative voltage applied to the backup roller 25, and when the image is then transferred onto the paper P, the transfer is induced by a repulsive force caused by a positive voltage applied to the paper transfer backup roller 26*b*.

First image charging units 30 are installed between the four color developing units of the developing unit 23. The first image charging units 30 serve to increase the potential of the image for each color transferred onto the transfer belt 24 before the image of a next color is transferred onto the transfer belt 24. The first image charging units 30 include a corona discharger 31 which includes a tungsten wire 31*a* to discharge a positive voltage having the same polarity as that of the developer, and a grid 31*b* to focus the direction of discharge of the image. The first image charging units 30 further include a corona backup roller 32 which supports the transfer belt 24 in a position opposite to the corona discharger 31. This allows the image not to be spread or dispersed even if a pressure caused by the photosensitive drums Dc, Dm, Dy, Dk is further generated when the image of a next color is transferred onto the transfer belt 24. This may occur by further increasing an electric force which acts to attach the image to the transfer belt 24 before the image of a next color is transferred onto the transfer belt 24.

In addition, a second image charging unit 40 is installed between the developing unit 23 and the transfer unit 26. The second image charging unit 40 reduces the potential of the image for each color developed on the four-color developing units of the developing unit 23 and transferred onto the transfer belt 24 before the image is transferred onto the paper P. The second image charging unit 40 includes a corona discharger 41 which includes a tungsten wire 41*a* to discharge to a negative voltage having a polarity opposite to that of the developer and a grid 41*b* to focus the direction of discharge on the image. The second image charging unit 40 further includes a corona backup roller 42 which supports the transfer belt 24 in a position opposite to the corona discharger 41. This allows an adhesive force which is greatly increased by the first image charging units 30 to be reduced such that the image is properly transferred onto the paper P by reducing the potential of the image to be transferred onto the paper P. That is, the image on the transfer belt 24 passing through the developing unit 23 is repeatedly charged by the first image charging units 30 installed between the four-color developing units, and thus the adhesive force to the transfer belt 24 is greatly increased. Thus, if a transfer operation onto the paper P is performed, transfer may not be properly performed, and many portions of the image may remain on the transfer belt 24. However, the second image charging unit 40 prevents this problem by recharging the image to the polarity opposite to that of the developer and properly reducing the adhesive force.

For this purpose, if a DC voltage between −6 and −5 kV is applied to the corona discharger 41 to charge the image, the adhesive force to the transfer belt 24 of the image having a positive potential is reduced, and a subsequent transfer operation in the transfer unit 26 is performed smoothly.

Meanwhile, an AC voltage having the opposite polarity, instead of the DC voltage, may be applied to the corona discharger 41. If the DC voltage is applied to the corona discharger 41, the image is directly charged to the opposite polarity and the adhesive force can be greatly reduced. However, if the AC voltage is applied to the corona discharger 41, the potential difference of the image can be reduced by reducing the adhesive force. Actually, when the AC voltage of 1 kHz and 3 kVrms is applied to the corona discharger 41, the voltage difference of 300–400 V before passing through the second image charging unit 40 is equalized to be less than 100 V. That is, there are wide differences between the potential of the single-color image formed on the transfer belt 24 and the potential of the multi-color overlapping image formed on the transfer belt 24.

For example, if the image is formed of only cyan, the image is charged by only the first image charging unit 30 placed between the cyan developing unit and the magenta developing unit, and thus the increase in potential is not large. However, if the image is formed of four colors, the image is charged three times by the first image charging unit 30 placed in each of the developing units, and thus the potential of the image is increased greatly after passing through the developing unit 23. Likewise, if the potential difference, i.e., the difference of the adhesive force, is increased depending on the image, it is difficult to set a proper transfer voltage in the transfer unit 26. Thus, if the AC voltage is applied to the corona discharger 41 of the second image charging unit 40, even though the adhesive force is reduced to less than when the DC voltage having the opposite polarity is applied to the corona discharger 41, the potential difference can be reduced. Thus, if the transfer voltage is properly set in the transfer unit 26, a transfer operation can be smoothly performed.

If an image forming operation is performed in the above structure, the image developed on the photosensitive drums Dc, Dm, Dy, and Dk in each developing unit of the developing unit 23 after charging, exposing, and developing operations, is first transferred onto the transfer belt 24 and is then overlapped on the transfer belt 24. In this case, a negative voltage is applied to the backup roller 25 and induces the positively charged image developed by the developer to be easily transferred onto the transfer belt 24. In addition, the potential of the image is increased by the first image charging unit 30 whenever the image for each color is transferred onto the transfer belt 24. That is, when the image passes between the corona discharger 31 and the corona backup roller 32, the corona discharger 31 is discharged, and the potential of the positively charged image is increased. For this purpose, a positive voltage is applied to the discharge wire 31*a*, and similarly, the positive voltage is applied to the grid 31*b* such that the discharged charge is not radiated and is focused on the image. As a result, the image formed on the transfer belt 24 has a higher adhesive force, and the image is not dispersed even though the image is compressed by the photosensitive drum in the developing unit of the next color.

The image formed on the transfer belt 24 passes through the second image discharging unit 40 before going to the transfer unit 26. Here, the potential of the image is affected by the corona discharger 41 to which a negative voltage having the polarity opposite to that of the developer is applied, and the potential of the image is reduced. As a result, the adhesive force of the image formed on the transfer belt 24 is reduced less and can be easily transferred onto the paper P by the transfer unit 26. Similarly, even if the AC voltage is applied to the corona discharger 41, the potential of the image is equalized to a low level, and the image can be easily transferred onto the paper P.

The image having a controlled potential suitable for transfer is transferred onto the paper P by the transfer unit 26. That is, the potential applying unit 26*c* applies a positive voltage to the paper transfer backup roller 26*b*, the positively charged image is transferred onto the paper P by a repulsive force. In this case, the potential of the image is reduced to be suitable for transfer by the second image charging unit 40, and thus a transfer operation from the transfer belt 24 onto the paper P is easily performed, and the image does not remain on the transfer belt 24 after the transfer operation.

Thus, when the image transferred onto the transfer belt 24 is transferred onto the paper P, the image is charged by the first and second image charging units 30 and 40 and the potential of the image is controlled such that a clear image is maintained and transfer efficiency is improved.

As described above, the image forming system of an electrophotographic printer according to the present invention has the following advantages.

First, the potential of the image is increased by the first image charging unit immediately after the image for each color is developed and is transferred onto the transfer body, and the electric adhesive force to the transfer body is increased, and thus the image is not dispersed when the image of a next color is overlapped and transferred.

Second, the increased potential of the image is reduced by the second image charging unit before the image transferred onto the transfer body is transferred onto the paper, and thus the image can be easily transferred onto paper.

Third, in particular, when the AC voltage is used in the second image charging unit, the potential difference of the image depending on color is reduced, and thus differences in transfer efficiency between different colors can be reduced.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. An image forming system of an electrophotographic printer, the system comprising:

a plurality of photosensitive bodies on which a plurality of electrostatic latent images are respectively formed;

a plurality of developing units, which respectively develop the electrostatic latent images with a plurality of developers having different colors;

a transfer body onto which the developed images are transferred;

a plurality of first image charging units respectively placed between the developing units and to charge the respective transferred images so as to increase an electric adhesive force of the respective transferred images to the transfer body;

a transfer unit; and a second image charging unit placed between the developing units and the transfer unit and to charge the transferred images so as to simultaneously reduce the increased electric adhesive forces of the transferred images, the transfer unit to transfer the images passing through the first and second image charging units onto the paper.

2. The system of claim 1, wherein the plurality of first image charging units each comprise:

a corona discharger comprising:

a discharge wire that is discharged to a same polarity as a polarity of the developer, and a grid to focus a direction of discharge of the respective charged image; and a corona backup roller which supports the transfer body in a position opposite to the corona discharger.

3. The system of claim 1, wherein the second image charging unit comprises:

a corona discharger comprising:

a discharge wire that is discharged to a polarity opposite to that of the developer, and a grid to focus a direction of discharge of the charged images; and a corona backup roller which supports the transfer body in a position opposite to the corona discharger.

4. The system of claim 1, wherein the second image charging unit comprises:

a corona discharger discharged by an AC voltage; and a corona backup roller which supports the transfer body in a position opposite to the corona discharger.

5. The system of claim 1, wherein the transfer unit comprises:

a paper transfer roller;

a paper transfer backup roller to abut the paper transfer roller, the paper transfer roller and the paper transfer backup roller rotating in opposite directions, with the transfer body being installed between the paper transfer roller and the paper transfer backup roller; and a potential applying unit which applies a voltage having a same polarity as a polarity of the developer to the paper transfer backup roller and to apply an electric force so that the images formed on the transfer body are transferred onto the paper when passing between the paper transfer roller and the transfer body.

6. A method of forming an image of an electrophotographic printer, the method comprising:

developing a plurality of electrostatic latent images respectively formed on a plurality of photosensitive bodies by a plurality of developers having different colors;

transferring the developed images onto a transfer body;

separately charging the developers of the different colors on the transfer body so that respective electric adhesive forces to the transfer body are increased;

charging the developers of the different colors on the transfer body so that the electric adhesive forces to the charged transfer body are simultaneously reduced; and transferring the charged images having the reduced force onto a paper.

7. An image forming system of an electrophotographic printer, the system comprising:

a body to receive a developed image formed with a plurality of developers having different colors;

a plurality of first image charging units to charge the developed image formed with the developers on the body to respectively increase an electric adhesive force between the developed image and the body; and a second image charging unit to charge the developed image to simultaneously reduce the increased electric adhesive forces between the developed image and the body.

8. The system of claim 7, wherein the plurality of first image charging units each comprises:

a corona discharger comprising:

a discharge wire that is discharged to a same polarity as a polarity of the developed image, and a grid to focus a direction of discharge of the developed image; and a corona backup roller which supports the body in a position opposite to the corona discharger.

9. The system of claim 7, wherein the second image charging unit comprises:

a corona discharger comprising:

a discharge wire that is discharged to a same polarity as a polarity of the developed image, and a grid to focus a direction of discharge of the developed image; and a corona backup roller which supports the body in a position opposite to the corona discharger.

10. The system of claim 7, wherein the second image charging unit comprises:

a corona discharger discharged by an AC voltage; and a corona backup roller which supports the body in a position opposite to the corona discharger.

11. A method comprising:

transferring a first developed image being formed of a first developer onto a transfer body;

charging the first developer to increase a first electric adhesive force of the first developed image to the transfer body;

overlapping a second developed image formed of a second developer onto the first developed image;

charging the second developer to increase a second electric adhesive force of the second developed image to the transfer body; and charging the first and second developers to simultaneously decrease the electric adhesive forces;

wherein the charging to increase the first and second electric adhesive forces comprises applying a voltage having a same polarity as polarities of the first and second developers to the first and second developers.

12. The method of claim 11, further comprising:

transferring the images having the decreased adhesive forces onto a recording medium.

13. The method of claim 11, wherein the charging to decrease the electric adhesive forces comprises applying a voltage having a polarity opposite to the polarities of the first and second developers to the first and second developers.

14. The method of claim 11, wherein the charging to decrease the electric adhesive forces comprises applying an AC voltage to the first and second developers.

* * * * *